US010309654B2

(12) United States Patent
Kamoi et al.

(10) Patent No.: US 10,309,654 B2
(45) Date of Patent: Jun. 4, 2019

(54) STRUCTURE FOR COOLING GAS TURBINE ENGINE

(71) Applicant: HONDA MOTOR CO., LTD., Tokyo (JP)

(72) Inventors: Yasuharu Kamoi, Wako (JP); Daisuke Kato, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 151 days.

(21) Appl. No.: 15/220,530

(22) Filed: Jul. 27, 2016

(65) Prior Publication Data

US 2018/0031243 A1 Feb. 1, 2018

(51) Int. Cl.

| | |
|---|---|
| ***F23R 3/28*** | (2006.01) |
| ***F23R 3/00*** | (2006.01) |
| ***F23R 3/10*** | (2006.01) |

(52) U.S. Cl.

CPC ..... *F23R 3/283* (2013.01); *F23R 3/002* (2013.01); *F23R 3/10* (2013.01); *F05B 2220/302* (2013.01); *F23R 2900/03044* (2013.01)

(58) Field of Classification Search

CPC .. F23R 3/002; F23R 3/02; F23R 3/283; F23R 2900/03043; F23R 2900/03044; F23R 3/10

See application file for complete search history.

(56) References Cited

U.S. PATENT DOCUMENTS 4,322,945 A * 4/1982 Peterson ..... F23R 3/283 60/740
6,279,323 B1 * 8/2001 Monty ..... F23R 3/06 60/732

FOREIGN PATENT DOCUMENTS

FR 2975467 B1 * 11/2013 ..... F23R 3/14
JP 04-244513 9/1992

* cited by examiner

*Primary Examiner* — Craig Kim
(74) *Attorney, Agent, or Firm* — Rankin, Hill & Clark LLP

(57) ABSTRACT

In a structure for cooling a gas turbine engine, an open flange part encircling a fuel supply hole formed in a combustor includes a conical portion enlarging in a conical shape toward an outside of the combustor and a flat portion extending radially outward in a flat plate shape from an extremity of the conical portion, and a nozzle guide includes a cylindrical portion covering an outer periphery of a fuel nozzle for supplying fuel to the fuel supply hole and a bottom flange portion being bent radially outward from a corner portion at an extremity of the cylindrical portion and supported in a floating state on the flat portion. A cooling hole for supplying air that cools the open flange part and the nozzle is formed in the corner portion of the guide, and a direction of the cooling hole is inclined toward an axis of the nozzle.

2 Claims, 5 Drawing Sheets

FIRST COMPARATIVE EXAMPLE

SECOND COMPARATIVE EXAMPLE

EMBODIMENT

STRUCTURE FOR COOLING GAS TURBINE ENGINE

BACKGROUND OF THE INVENTION

Field of the Invention

The present invention relates to a structure for cooling a gas turbine engine in which an open flange part encircling a fuel supply hole formed in a combustor of the gas turbine engine comprises a conical portion that enlarges in a conical shape in going toward an outside of the combustor and a flat portion that extends radially outward in a flat plate shape from an extremity of the conical portion, and a nozzle guide comprises a cylindrical portion that covers an outer periphery of a fuel nozzle for supplying fuel to the fuel supply hole and a bottom flange portion that is bent radially outward from a corner portion at an extremity of the cylindrical portion and is supported in a floating state on the flat portion.

Description of Related Art

Japanese Patent Application Laid-open No. 4-244513 has made known an arrangement that enables a constant amount of air to flow in a gap between a support plate 50 (open flange part) and a fuel injection nozzle 32 (fuel nozzle) fitted into a ferrule 58 (nozzle guide), even when the fuel injection nozzle 32 moves relative to the support plate 50, by welding a retaining plate 74 (cap) to extremities of elliptical flanges 70*a* to 70*d* projectingly provided on the support plate 50 encircling a dome inlet 28 (fuel supply hole) of a combustor 10 and by supporting the ferrule 58 in a floating state in a space formed between the support plate 50 and the retaining plate 74.

When an open flange part encircling a fuel supply hole formed in a combustor of a gas turbine engine includes a conical portion and a flat portion, a nozzle guide supporting a fuel nozzle for supplying fuel to the fuel supply hole includes a cylindrical portion and a bottom flange portion, and the open flange part and the fuel nozzle are cooled with air for cooling that is supplied via a cooling hole formed in the bottom flange portion of the nozzle guide, as described in detail in the 'DESCRIPTION OF THE PREFERRED EMBODIMENT' section of the present Specification, if an axial height of the fuel nozzle of the open flange part is decreased in order to achieve a lightening of weight, the cooling hole in the bottom flange portion of the nozzle guide is blocked by the flat portion of the open flange part, and there is a possibility that it will become difficult to supply air for cooling via the cooling hole.

SUMMARY OF THE INVENTION

The present invention has been accomplished in light of the above circumstances, and it is an object thereof to enable air for cooling to be reliably supplied via a cooling hole formed in a nozzle guide while achieving a lightening of weight by decreasing an axial height of a fuel nozzle of an open flange part.

In order to achieve the object, according to a first aspect of the present invention, there is provided a structure for cooling a gas turbine engine in which an open flange part encircling a fuel supply hole formed in a combustor of the gas turbine engine comprises a conical portion that enlarges in a conical shape in going toward an outside of the combustor and a flat portion that extends radially outward in a flat plate shape from an extremity of the conical portion, and a nozzle guide comprises a cylindrical portion that covers an outer periphery of a fuel nozzle for supplying fuel to the fuel supply hole and a bottom flange portion that is bent radially outward from a corner portion at an extremity of the cylindrical portion and is supported in a floating state on the flat portion, wherein a cooling hole for supplying air that cools the open flange part and the fuel nozzle is formed in the corner portion of the nozzle guide, and a direction of the cooling hole is inclined toward an axis of the fuel nozzle.

In accordance with the first aspect, the open flange part encircling the fuel supply hole formed in the combustor of the gas turbine engine includes the conical portion that enlarges in a conical shape in going toward the outside of the combustor and the flat portion that extends radially outward in a flat plate shape from the extremity of the conical portion, and the nozzle guide includes the cylindrical portion that covers the outer periphery of the fuel nozzle for supplying fuel to the fuel supply hole and the bottom flange portion that is bent radially outward from the corner portion at the extremity of the cylindrical portion and is supported in a floating state on the flat portion. Since the cooling hole for supplying air that cools the open flange part and the fuel nozzle is faulted in the corner portion of the nozzle guide, and the direction of the cooling hole is inclined toward the axis of the fuel nozzle, even when the axial height of the fuel nozzle of the open flange part is decreased so as to achieve a lightening of weight, it is possible to avoid blocking of the cooling hole of the nozzle guide by the flat portion and, moreover, since the radial dimension of the flat portion can be reduced by an amount corresponding to the cooling hole due to its absence, it becomes possible to further lighten the weight.

According to a second aspect of the present invention, in addition to the first aspect, the direction of the cooling hole is inclined in a circumferential direction with the axis of the fuel nozzle as a center.

In accordance with the second aspect, since the direction of the cooling hole is inclined in a circumferential direction with the axis of the fuel nozzle as the center, a swirl flow due to air supplied from the outer peripheral part of the fuel nozzle to the combustor is assisted by a swirl flow generated by air supplied via the cooling hole in the corner portion of the nozzle guide, thus enabling stable combustion of an air-fuel mixture in the combustor.

According to a third aspect of the present invention, in addition to the first or second aspect, the nozzle guide is a press-formed product.

In accordance with the third aspect, since the nozzle guide is a press-formed product, it is possible to reduce the cost compared with a case in which the nozzle guide is produced by machining.

The above and other objects, characteristics and advantages of the present invention will be clear from detailed descriptions of the preferred embodiment which will be provided below while referring to the attached drawings.

BRIEF DESCRIPTION OF THE DRAWINGS

FIG. 1 to FIG. 5C show an embodiment of the present invention:

FIG. 1 is a longitudinal sectional view of a combustor of a gas turbine engine;

FIG. 2 is an enlarged view of part 2 in FIG. 1;

FIG. 3 is a view in the direction of arrow 3 in FIG. 1;

FIG. 4 is a view in the direction of arrow 4 in FIG. 1; and

FIG. 5A to FIG. 5C are diagrams for comparison between a comparative example and the embodiment.

DESCRIPTION OF THE PREFERRED EMBODIMENT

An embodiment of the present invention is explained below by reference to FIG. 1 to FIG. 5C.

Figure 1:
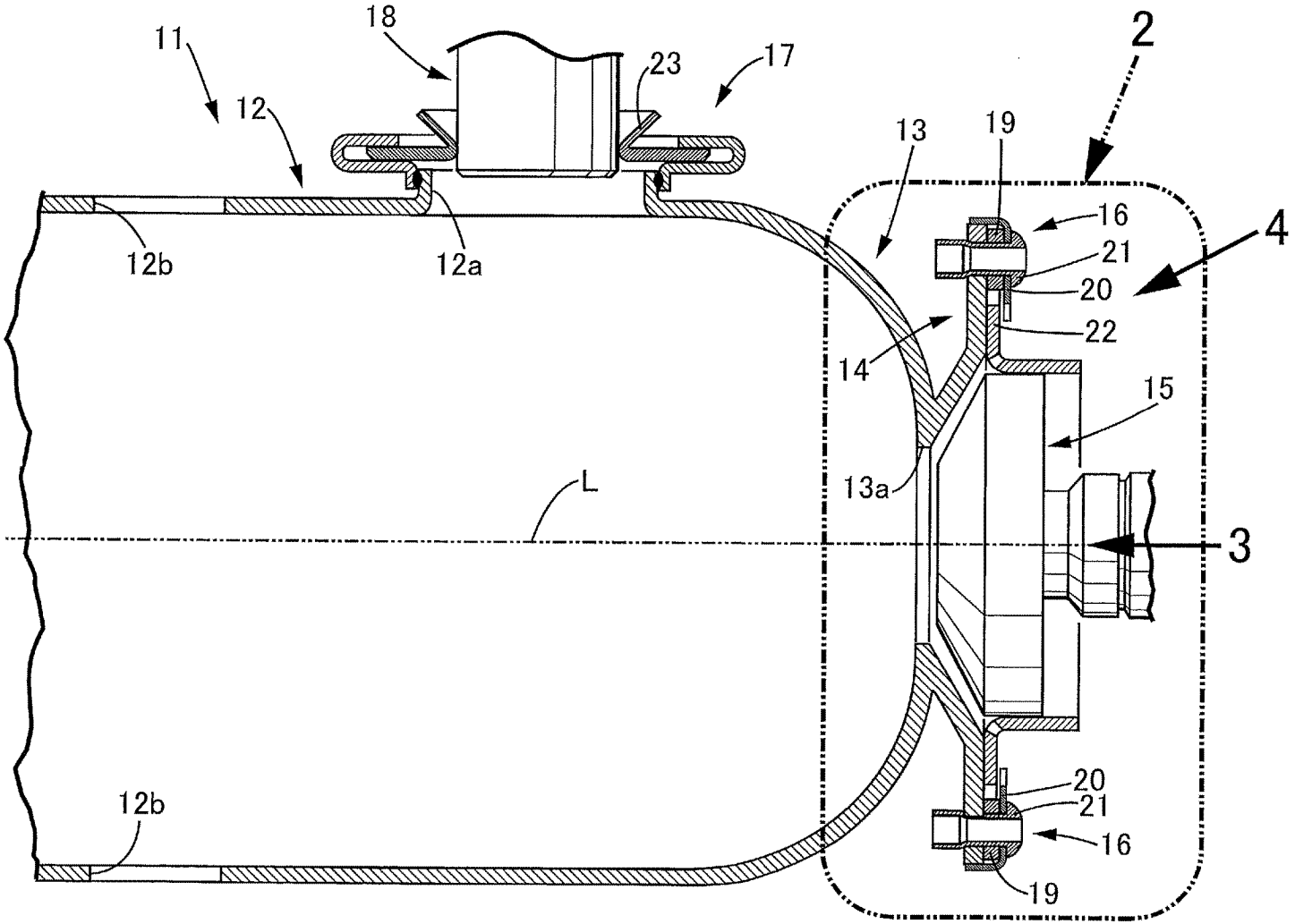

As shown in FIG. 1, a combustor 11 disposed so as to encircle an engine axis of a gas turbine engine includes an annular combustor main body part 12 and a dome part 13 blocking one end part of the combustor main body part 12. A plurality of open flange parts 14 are disposed, at equal intervals on a circumference having the engine axis as the center, on the semicircular cross section dome part 13, and the extremities of fuel nozzles 15 for injecting fuel into the interior of the combustor 11 via fuel supply holes 13*a* formed in the center of the open flange parts 14 are covered with a nozzle guide 22 supported in a floating state by nozzle guide support means 16. Furthermore, a plurality of spark plug fitting holes 12*a* are formed in an outer peripheral wall of the combustor main body part 12 at equal intervals in the circumferential direction, and the extremities of spark plugs 18 are inserted into spark plug support collars 23 supported in a floating state by spark plug support means 17 provided on the spark plug fitting holes 12*a*. The fuel nozzle 15 includes an air supply hole encircling the periphery of the fuel injection hole, and air passing through the air supply hole is supplied into the interior of the combustor 11 via the periphery of the fuel injection hole in a swirl flow.

The combustor 11 is cantilever-supported on a casing of the gas turbine engine via an inner peripheral part thereof, and since base end parts of the fuel nozzles 15 and the spark plugs 18 are cantilever-supported on the casing, the fuel nozzles 15 and the spark plugs 18 move relative to the combustor 11 due to a difference in the amount of thermal expansion of each part accompanying change in temperature of the gas turbine engine. In order to allow this relative movement, the extremities of the fuel nozzles 15 are covered with the nozzle guide 22 supported on the nozzle guide support means 16 in a floating state, and the extremities of the spark plugs 18 are inserted into spark plug support collars 23 supported by the spark plug support means 17 in a floating state. Formed in the outer peripheral wall and an inner peripheral wall of the combustor main body part 12 are a plurality of air inlet holes 12*b* for introducing air for combustion into the interior of the combustor 11.

Figure 2:
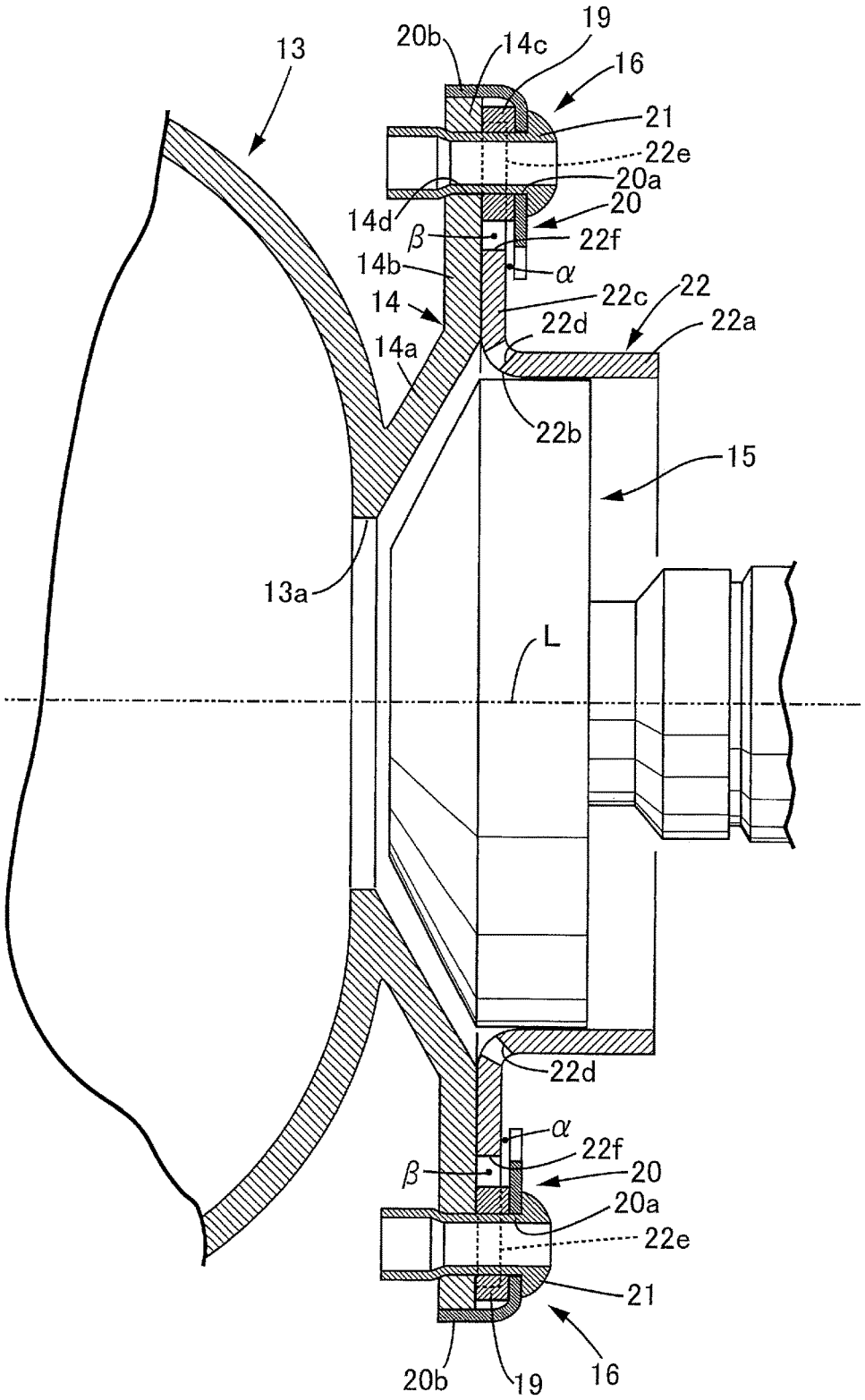

The structure of the nozzle guide support means 16 is now explained by reference to FIG. 2 to FIG. 4.

The open flange part 14 of the combustor 11 includes a conical portion 14*a* that enlarges in a conical shape from the outer periphery of the fuel supply hole 13*a* along an axis L of the fuel nozzle 15, a flat portion 14*b* that extends from the extremity of the conical portion 14*a* radially outward with respect to the axis L, and two projecting portions 14*c* that project radially outward from two positions, having the axis L interposed therebetween, at the radially outer ends of the flat portion 14*b*, rivet holes 14*d* extending through extremities of the projecting portions 14*c*. A cylindrical spacer 19 and a cap 20 formed by bending a plate material are superimposed on the projecting portion 14*c* and are fixed by swaging the extremity of a rivet 21 extending in the axis L direction through a rivet hole 20*a* of the cap 20, the spacer 19, and the rivet hole 14*d* of the projecting portion 14*c*. Formed at the radially outer end of the cap 20 is a stopper portion 20*b* that is bent at right angles, the stopper portion 20*b* engaging with an outer peripheral face of the radially outer end of the projecting portion 14*c* of the open flange part 14.

The nozzle guide 22, which is formed into an annular shape, includes a cylindrical portion 22*a* into which the fuel nozzle 15 is fitted and a bottom flange portion 22*c* that is bent from a corner portion 22*b* at one end of the cylindrical portion 22*a* at right angles and extends radially outward, and a plurality of cooling holes 22*d* are formed to extend through the corner portion 22*b*. Two projecting portions 22*e* superimposed on the two projecting portions 14*c* of the open flange part 14 project from radially outer ends of the bottom flange portion 22*c* of the nozzle guide 22, and U-shaped recess portions 22*f* opening radially outward are formed in the projecting portions 22*e*.

The nozzle guide 22 of the present embodiment is a press-formed product, and the production cost is greatly reduced compared with a case in which it is formed from a machined product.

Figure 3:
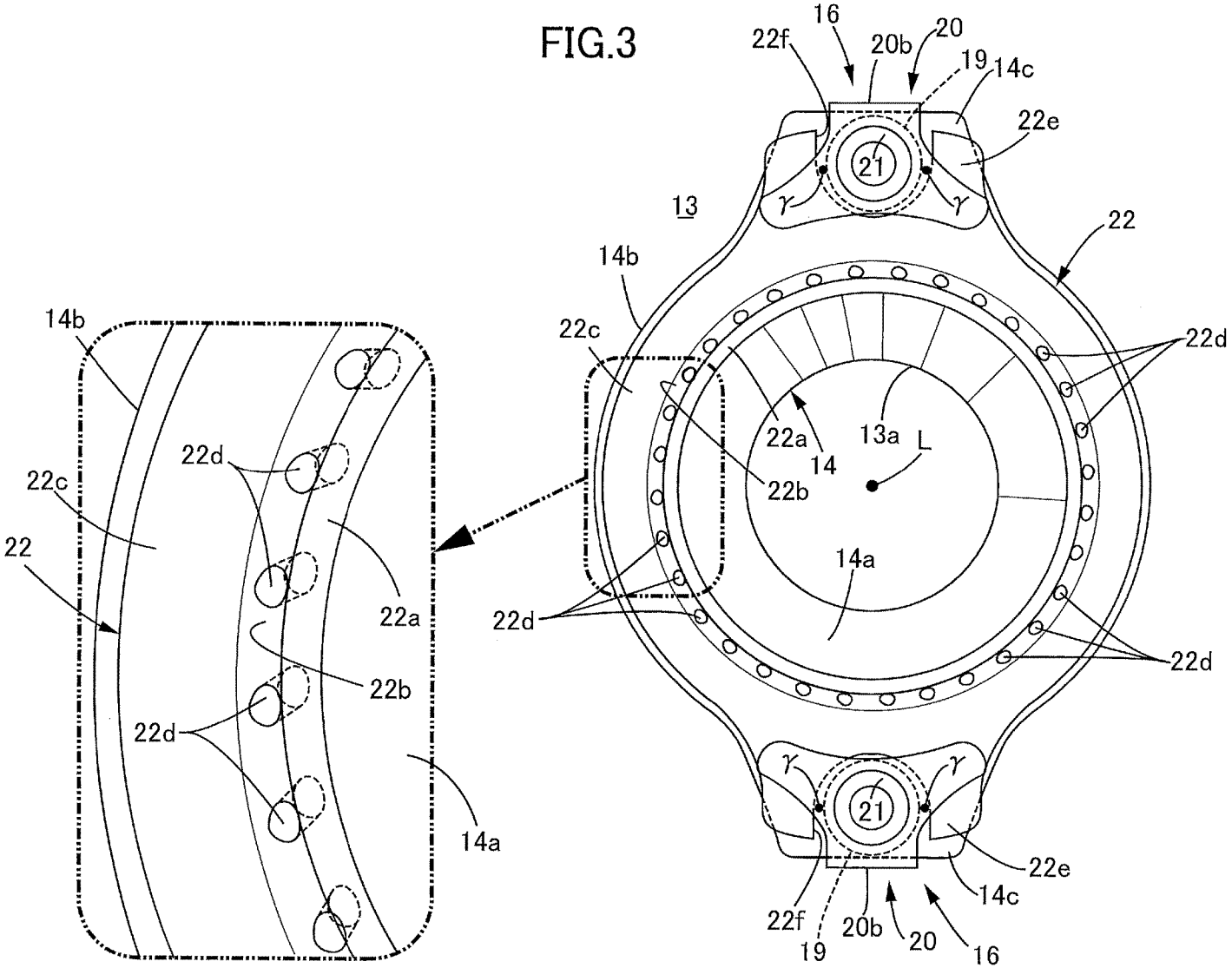
Figure 4:
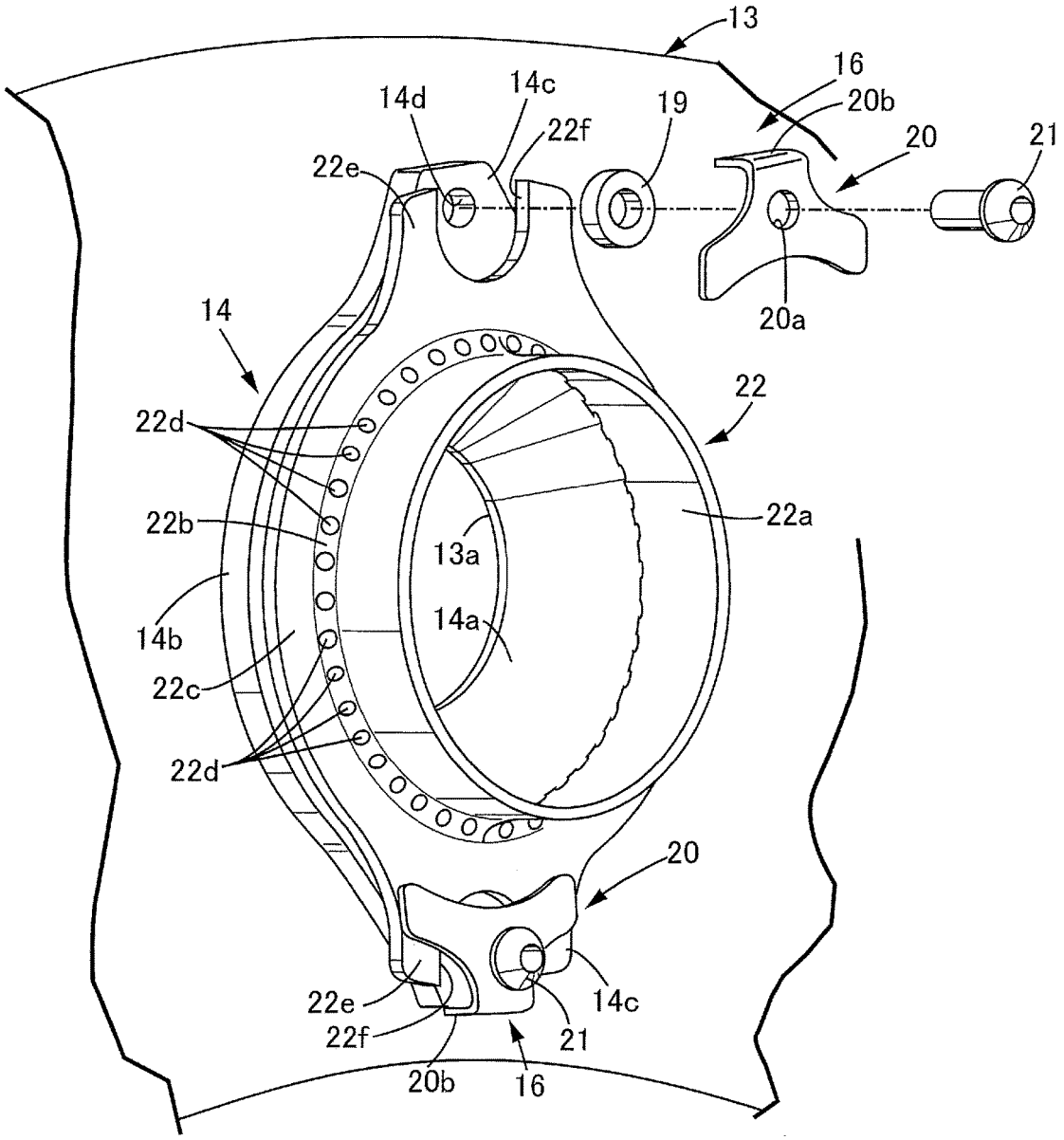

The cooling holes 22*d* of the nozzle guide 22 are inclined toward the axis L side in going from the outside to the inside of the combustor 11 when viewed in a direction orthogonal to the axis L (see FIG. 2) and are inclined toward one side in the circumferential direction with respect to the axis L in going from the outside to the inside of the combustor 11 when viewed in the axis L direction (see FIG. 3). The swirl direction of air supplied to the interior of the combustor 11 after passing through the cooling holes 22*d* of the nozzle guide 22 is set so as to be the same direction (clockwise direction in the present embodiment) as the swirl direction of air that is supplied to the interior of the combustor 11 after passing through the interior of the fuel nozzle 15.

The projecting portion 22*e* of the nozzle guide 22 is sandwiched between the cap 20 and the projecting portion 14*c* of the open flange part 14, and the recess portion 22*f* of the nozzle guide 22 is loosely fitted onto the outer periphery of the spacer 19. In this state, the bottom flange portion 22*c* and the projecting portion 22*e* of the nozzle guide 22 have a gap $\alpha$ (see FIG. 2) in the axis L direction between the cap 20 and the flat portion 14*b* and the projecting portion 14*c* of the open flange part 14. The recess portion 22*f* of the nozzle guide 22 has a gap $\beta$ (see FIG. 2) in the radial direction and a gap $\gamma$ (see FIG. 3) in the circumferential direction between itself and the outer periphery of the spacer 19. Therefore, the nozzle guide 22 can move in the axis L direction, the radial direction, and the circumferential direction relative to the open flange part 14.

The operation of the embodiment of the present invention having the above arrangement is now explained.

During running of the gas turbine engine, air that has been compressed by a compressor is supplied to a space around the combustor 11 and is supplied therefrom to the interior of the combustor 11 after passing through the air inlet holes 12*b* of the combustor main body part 12 and the interior of the fuel nozzles 15, and the air is mixed with fuel injected from the fuel nozzle 15 in the interior of the combustor 11, thus carrying out combustion. Combustion gas generated by combustion is discharged from the combustor 11 and drives a turbine, and is then discharged via an exhaust nozzle and generates thrust. The spark plugs 18 ignite the mixed gas when the gas turbine engine is started, and combustion of the mixed gas continues automatically after starting the gas turbine engine.

Furthermore, air in the space around the combustor 11 passes through the cooling holes 22*d* of the nozzle guide 22 and is supplied to the interior of the combustor 11, and in this process it cools the open flange part 14 and the fuel nozzle 15. Air that has been supplied to the interior of the combustor 11 after passing through the cooling holes 22*d* is used for the combustion of fuel; since the cooling holes 22*d* are disposed so as to encircle the outer periphery of the fuel nozzle 15 and the swirl direction of air that is supplied to the interior of the combustor 11 after passing through the cooling holes 22*d* is set so as to be the same direction as the swirl direction of air that is supplied to the interior of the combustor 11 after passing through the interior of the fuel nozzle 15, it is possible to form a strong swirl flow in the interior of the combustor 11 to thus stabilize the combustion of an air-fuel mixture.

Since the annular combustor 11 is cantilever-supported on the casing of the gas turbine engine via its inner peripheral part, and the base end parts of the fuel nozzles 15 and the spark plugs 18 are also cantilever-supported on the casing of the gas turbine engine, the fuel nozzles 15 and the spark plugs 18 move relative to the combustor 11 due to differences in the amount of thermal expansion accompanying change in temperature of the gas turbine engine.

However, since the nozzle guide 22 of the fuel nozzle 15 is supported on the open flange part 14 of the combustor 11 via the nozzle guide support means 16, this nozzle guide support means 16 enables the nozzle guide 22 to move relative to the open flange part 14 in the axis L direction in a range of the gap α, in the radial direction in a range of the gap β, and in the circumferential direction in a range of the gap γ, these relative movements being allowed by the action of the gaps α, β, and γ.

Since assembly of the nozzle guide support means 16 is carried out by swaging the extremity of the rivet 21 extending through the rivet hole 20*a* of the cap 20, the spacer 19, and the rivet hole 14*d* of the projecting portion 14*c* of the open flange part 14 in the axis L direction, it becomes possible to cut the production time and the production cost compared with a case in which the nozzle guide support means 16 is assembled by welding or brazing.

Furthermore, since the nozzle guide support means 16, which are divided into two parts, are disposed on the open flange part 14 at intervals of 180° in the circumferential direction, it is possible to cut the total weight of the nozzle guide support means 16 compared with a case in which one nozzle guide support means 16 is provided so as to follow the entire periphery of the open flange part 14.

Moreover, since the nozzle guide support means 16 includes the cap 20 supporting the nozzle guide 22 in a floating state, the rivet 21 fixing the cap 20 to the open flange part 14, and the spacer 19 fitted onto the outer periphery of the rivet 21 to thus form a projecting part for preventing rotation, not only is it possible to easily and reliably fix the cap 20 to the open flange part 14, but it is also possible to restrict the gap in the axis L direction between the open flange part 14 and the cap 20 with good precision by utilizing the spacer 19 forming the projecting part.

Moreover, since the cap 20 includes the stopper portion 20*b*, which can abut against the outer peripheral face of the projecting portion 14*c* of the open flange part 14, it is possible by means of the stopper portion 20*b* to prevent the cap 20 from rotating around the rivet 21.

Figure 5A:
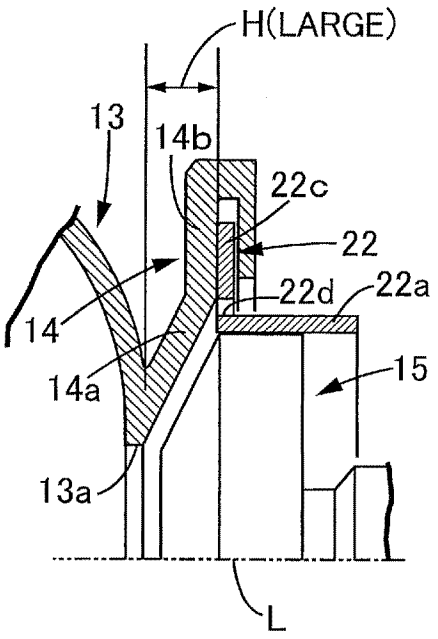

FIG. 5A shows a first comparative example of the present invention; a height H of an open flange part 14 projecting in the axis L direction is large, and cooling holes 22*d* of a nozzle guide 22 are formed in parallel to the axis L direction in a bottom flange portion 22*c*. This first comparative example has the problem that the weight is large due to the height H of the open flange part 14 being large.

Figure 5B:
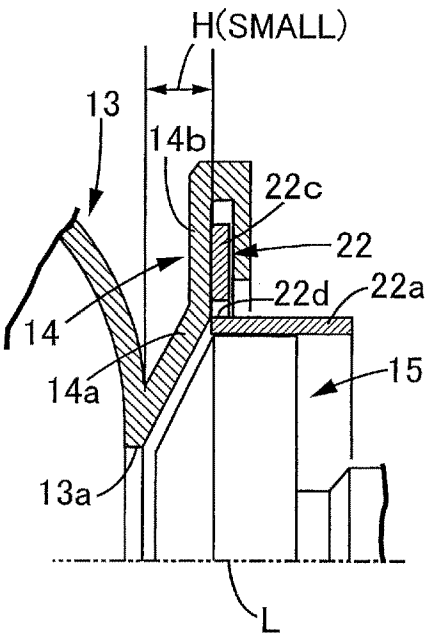

FIG. 5B shows a second comparative example of the present invention; in order to lighten the weight a height H of an open flange part 14 is changed to be small. When the height H of the open flange part 14 is small, since the radial length of a flat portion 14*b* that abuts against a bottom flange portion 22*c* of a nozzle guide 22 increases, there is the problem that cooling holes 22*d* formed in the bottom flange portion 22*c* are blocked by the flat portion 14*b*.

Figure 5C:
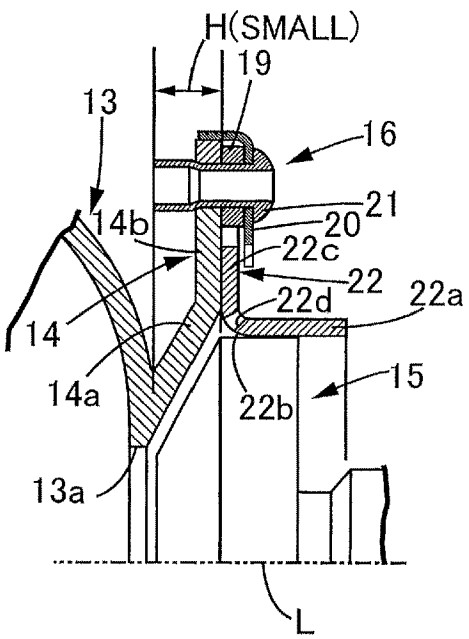

FIG. 5C is the embodiment; the weight is lightened by making the height H of the open flange part 14 small as in the second comparative example, but since the cooling holes 22*d* are formed in the corner portion 22*b* and not in the bottom flange portion 22*c* of the nozzle guide 22, and the cooling holes 22*d* are formed not in parallel to the axis L direction but radially inward toward the axis L, the cooling holes 22*d* will not be blocked by the flat portion 14*b* of the open flange part 14. Moreover, since the bottom flange portion 22*c* of the nozzle guide 22 does not include the cooling holes 22*d*, it is possible to reduce the radial dimension of the bottom flange portion 22*c* by an amount corresponding to the cooling holes 22*d*, thus further lightening the weight.

An embodiment of the present invention is explained above, but the present invention may be modified in a variety of ways as long as the modifications do not depart from the gist thereof.

For example, the structure of the nozzle guide support means 16 supporting the nozzle guide 22 in a floating state is not limited to that of the embodiment.

What is claimed is:

1. A structure for cooling a gas turbine engine in which an open flange part encircling a fuel supply hole formed in a combustor of the gas turbine engine comprises a conical portion that enlarges in a conical shape in going toward an outside of the combustor and a flat portion that extends radially outward in a flat plate shape from an extremity of the conical portion, and a nozzle guide comprises a cylindrical portion that covers an outer periphery of a fuel nozzle for supplying fuel to the fuel supply hole and a bottom flange portion that is bent radially outward from a corner portion at an extremity of the cylindrical portion and is supported in a floating state on the flat portion, wherein a plurality of caps for supporting the bottom flange portion in the floating state are fixed to the flat portion, and a cooling hole for supplying air that cools the open flange part and the fuel nozzle is formed in the corner portion of the nozzle guide, and a direction of the cooling hole is inclined toward an axis of the fuel nozzle, and wherein the direction of the cooling hole is inclined toward the axis side in going from the outside of the combustor to an inside of the combustor when viewed in a direction orthogonal to the axis, and the direction of the cooling hole is also inclined toward one side in a circumferential direction with respect to the axis in going from the outside of the combustor to the inside of the combustor when viewed in the axis direction.

2. The structure for cooling a gas turbine engine according to claim 1, wherein the nozzle guide is a press-formed product.

* * * * *